US010054330B2

(12) United States Patent
Coles

(10) Patent No.: US 10,054,330 B2
(45) Date of Patent: Aug. 21, 2018

(54) CLOSABLE VENTILATION VENT FOR COMMERCIAL AND RESIDENTIAL STRUCTURES AND METHOD OF USE THEREOF

(71) Applicant: Benjamin Coles, Monument, CO (US)

(72) Inventor: Benjamin Coles, Monument, CO (US)

( * ) Notice: Subject to any disclaimer, the term of this patent is extended or adjusted under 35 U.S.C. 154(b) by 1023 days.

(21) Appl. No.: 14/476,460

(22) Filed: Sep. 3, 2014

(65) Prior Publication Data

US 2015/0072610 A1 Mar. 12, 2015

Related U.S. Application Data

(60) Provisional application No. 61/876,095, filed on Sep. 10, 2013.

(51) Int. Cl.
*F24F 7/007* (2006.01)
*F24F 13/12* (2006.01)

(52) U.S. Cl.
CPC ..... *F24F 13/12* (2013.01)

(58) Field of Classification Search
CPC ..... F24F 13/12
USPC ..... 454/32, 298
See application file for complete search history.

(56) References Cited

U.S. PATENT DOCUMENTS 2,936,692 A 5/1955 White
2,930,309 A * 3/1960 Prager ..... F24F 13/12 454/280
2,995,079 A * 8/1961 La Fontaine ..... F24F 13/12 454/292
3,308,741 A 3/1967 Chambers
4,407,187 A * 10/1983 Horney ..... F24F 13/085 454/324
4,760,773 A 8/1988 Pezzulli
5,207,614 A 5/1993 Passadore
5,564,975 A * 10/1996 Northcutt ..... F24F 13/06 454/292
6,945,867 B2 9/2005 Park
7,195,556 B1 * 3/2007 Fichtelman ..... E04D 13/152 454/260
8,142,265 B2 3/2012 Carter
2003/0056557 A1 * 3/2003 Squier ..... E05B 9/08 70/278.1
2013/0247480 A1 9/2013 Ridgway

FOREIGN PATENT DOCUMENTS

JP 10132347 A * 5/1998 ..... F24F 13/12

OTHER PUBLICATIONS

English translation of the Abstract o f the document HP10132347A.*

* cited by examiner

*Primary Examiner* — Helena Kosanovic
(74) *Attorney, Agent, or Firm* — Leyendecker & Lemise, LLC

(57) ABSTRACT

A ventilation assembly with closable vent openings is described primarily for use on the soffit of a building. A slider that is differently and contrastingly colored relative to a frame and having an actuator tab is provided within the frame wherein the vent opening can be opened or closed by sliding the slider between two positions by way of the actuator tab.

2 Claims, 10 Drawing Sheets

CLOSABLE VENTILATION VENT FOR COMMERCIAL AND RESIDENTIAL STRUCTURES AND METHOD OF USE THEREOF

The present application claims priority to and incorporates by reference U.S. patent application No. 61/876,095, filed Sep. 10, 2013, titled CLOSABLE VENTILATION VENT FOR COMMERCIAL AND RESIDENTIAL STRUCTURES and having the same inventors as the present application.

BACKGROUND

Proper and adequate ventilation of attics, roofs, and crawl spaces in commercial and residential structures is very important. Many building code enforcement agencies require that these ventilation systems allow and permit sufficient airflow into and out of attics, roofs, and crawl spaces to prevent ice dams, excessive heating, condensation, mold, and mildew problems due to insufficient airflow. Many building code enforcement agencies also require that these ventilation systems include a metal screen for the purpose of minimizing the intrusion of burning embers and preventing the entry of pests and insects through the ventilation vents.

An example of this type of ventilation system may be found on the typical residential house, where intake vents are commonly located along the soffit area, below the roofline, and exhaust vents are commonly located along the roof ridgeline or on the top of the roof surface itself. When installed properly, these ventilation systems prove to be very valuable. However, these ventilation systems are also a cause of concern as it relates to the unwanted entry of burning embers, ashes, water, and debris, which can enter through the vents in the ventilation system.

During a wildfire, ashes and burning embers are known to be carried away from the fire by the wind. When these ashes and burning embers are blown against a structure such as a house, they can rise up the exterior wall and become pulled into the attic by the airflow which naturally flows into the attic through the intake vents commonly located along the soffit area. In another example, during a hurricane, water and flying debris are known to penetrate common building ventilation systems due to the high winds and pressure differentials which this wind can cause from one side of the structure to the other.

For both wildfires and hurricanes, one can easily understand the problems that these scenarios present. When burning embers enter a structure through common ventilation systems, they can smolder and burn and ignite the structure from the inside, causing significant property loss, as is well documented in numerous fire research studies. Additionally, when water and flying debris are blown into a structure through common ventilation systems, or when pressure differentials become extreme, tremendous damage is likely and the repair costs can be extremely high. This is also well documented in post-hurricane property damage assessments.

BRIEF DESCRIPTION OF THE DRAWINGS

Description of the Drawings

The included and referenced drawings illustrate the method and system of the invention, although it will be understood that such drawings depict embodiments of the invention and, therefore, are not to be considered as limiting its scope with regard to other embodiments.

Figure 1:
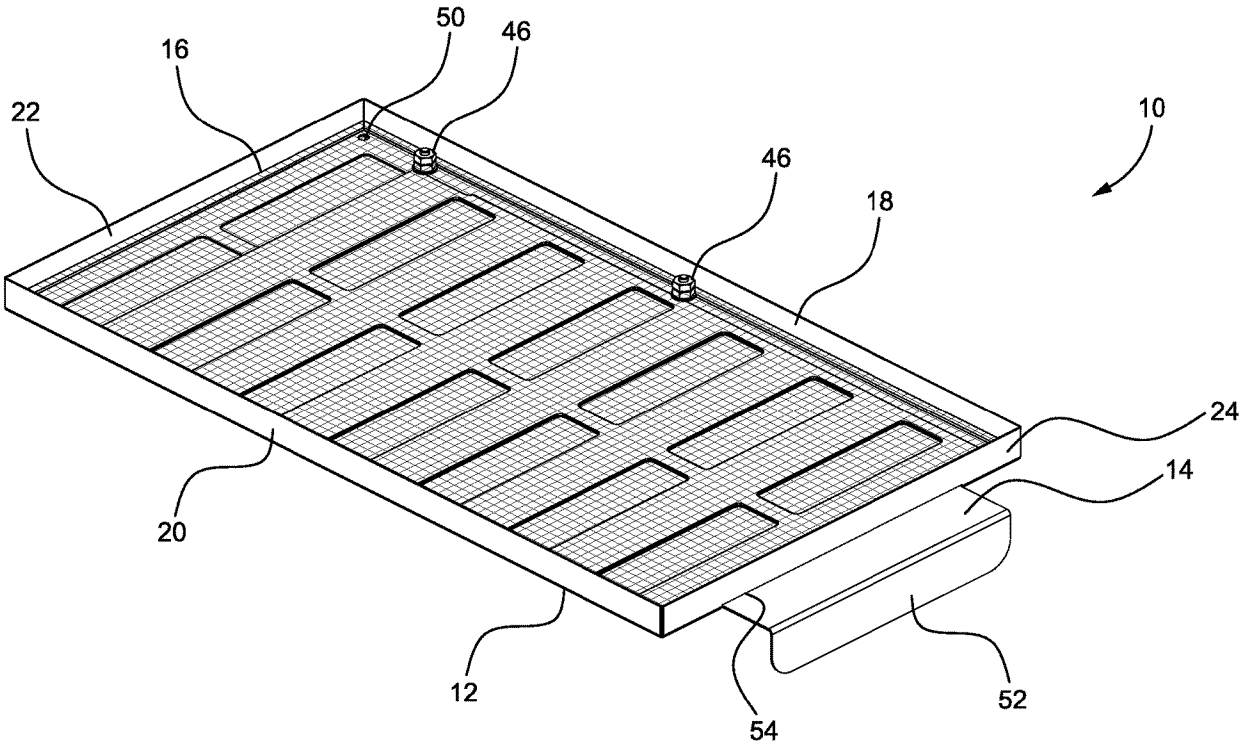

FIG. 1 is a perspective view showing the vent in the assembled state according to one embodiment of the present invention.

Figure 2:
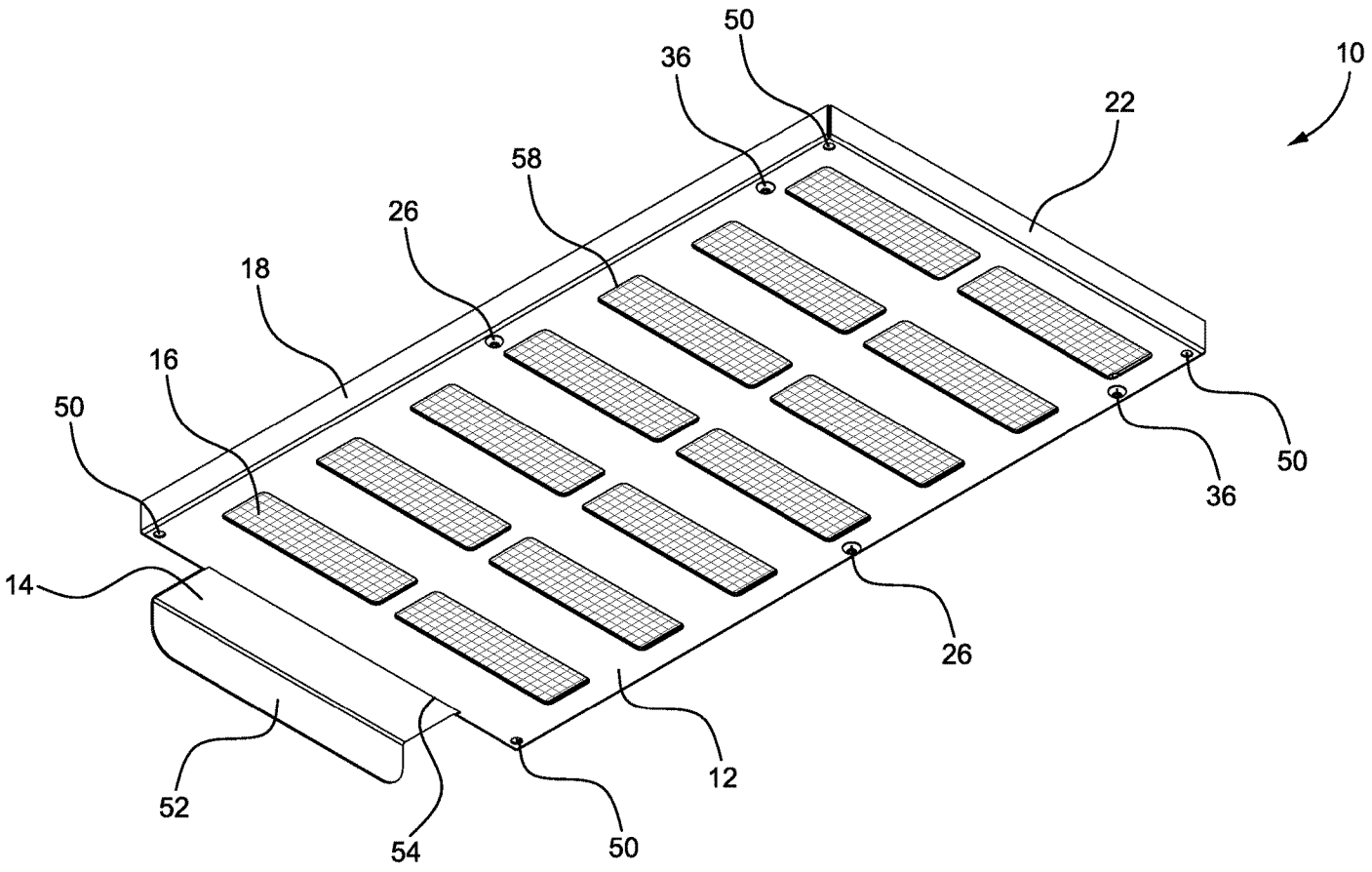

FIG. 2 is another perspective view showing the vent in the assembled state according to one embodiment of the present invention.

Figure 3:
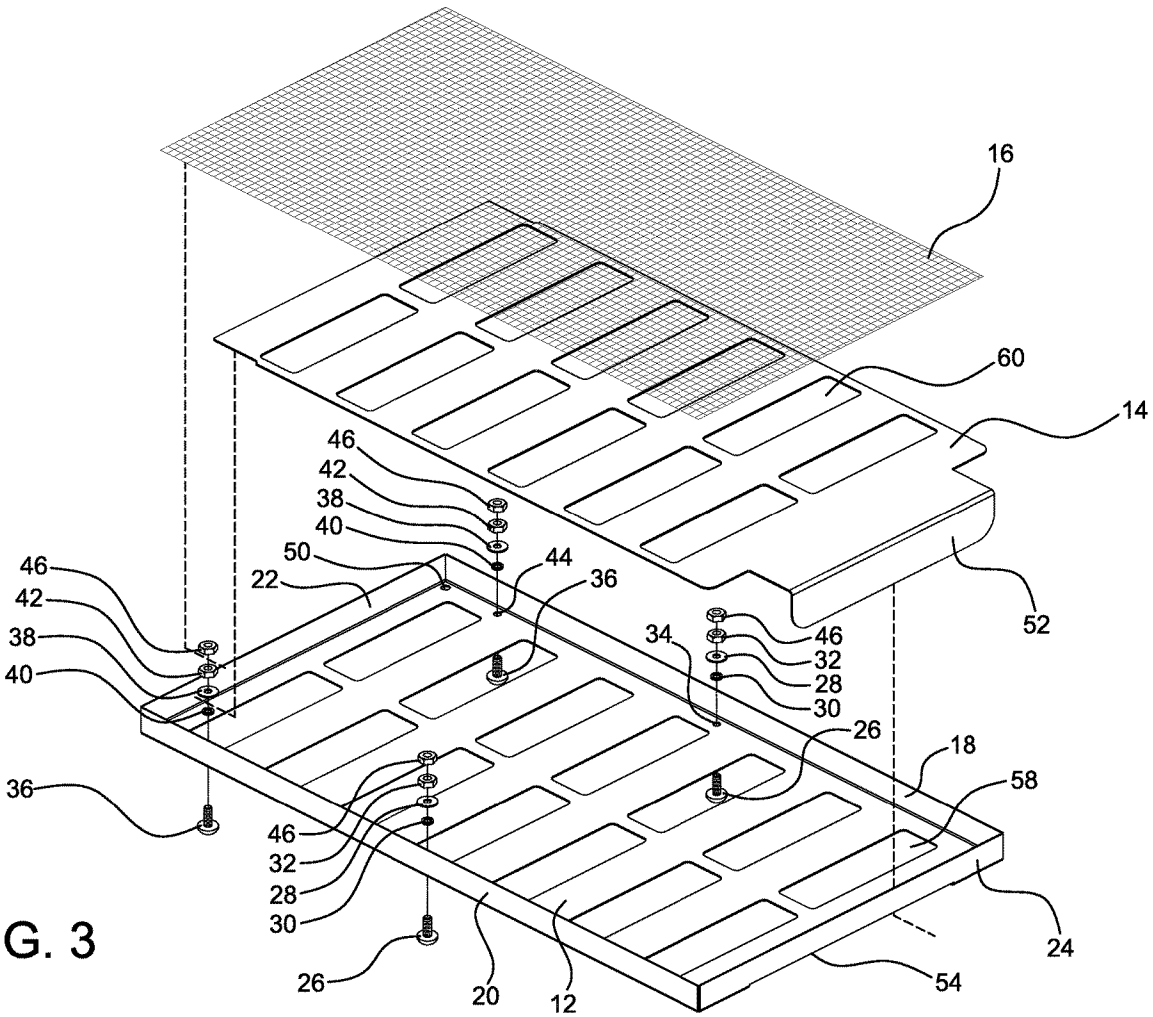

FIG. 3 is an exploded perspective view of the vent showing the metal screen, moveable slider, retention hardware, and guide hardware separated from the rigid frame according to one embodiment of the present invention.

Figure 4:
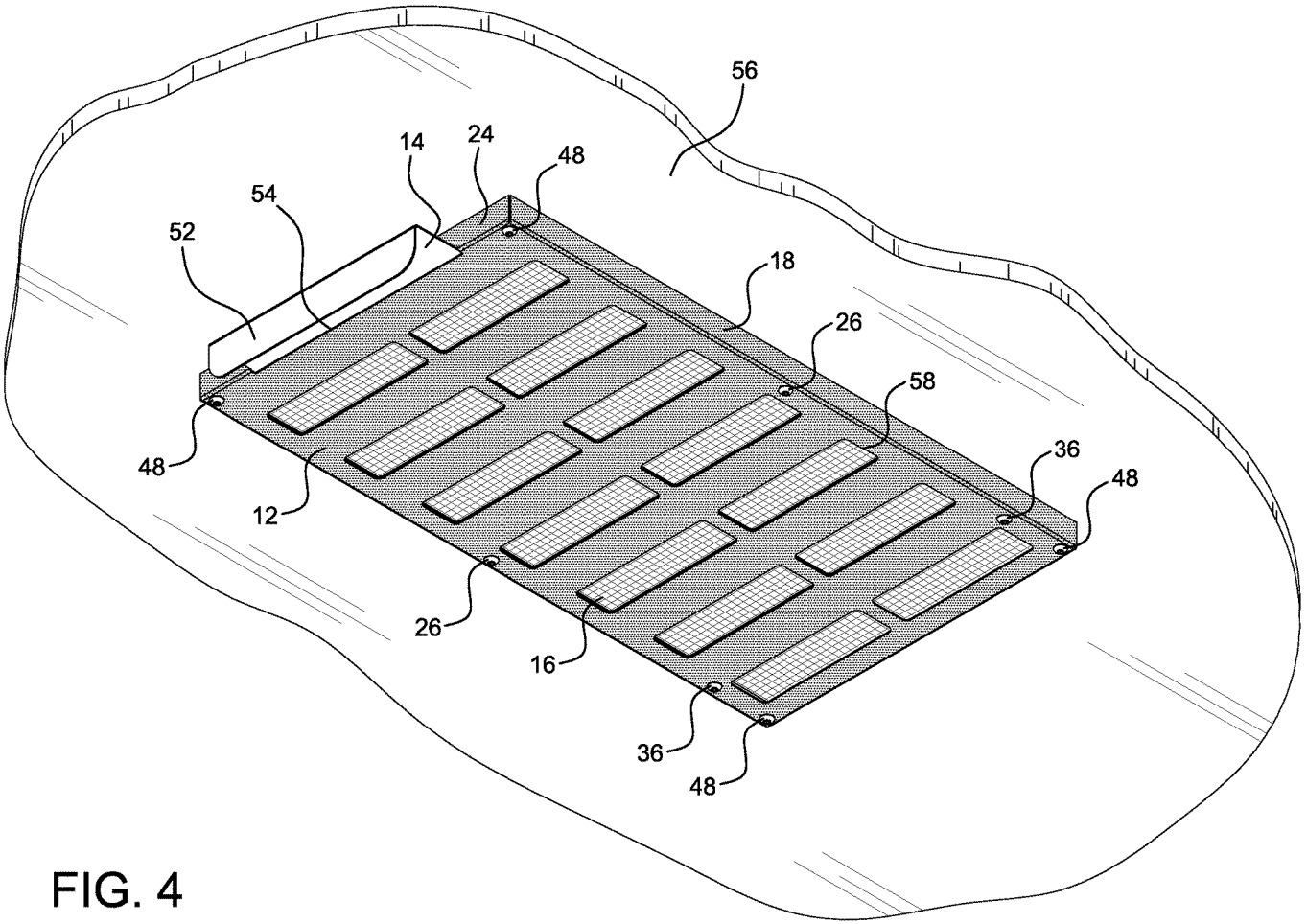

FIG. 4 is a perspective view showing the vent installed onto a soffit panel with the moveable slider being in the open position according to one embodiment of the present invention.

Figure 5:
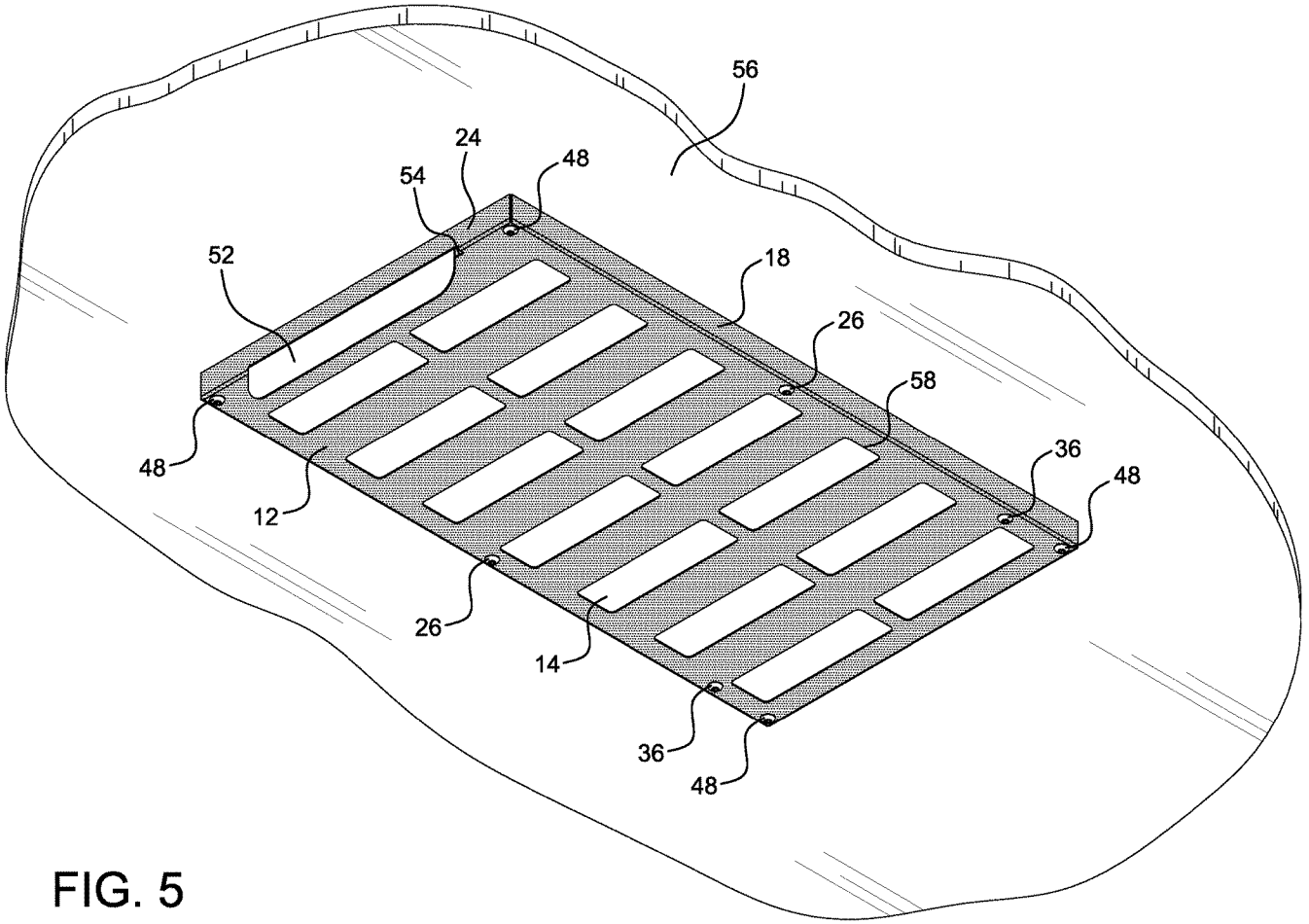

FIG. 5 is a perspective view showing the vent installed onto a soffit panel with the moveable slider being in the closed position according to one embodiment of the present invention.

Figure 6:
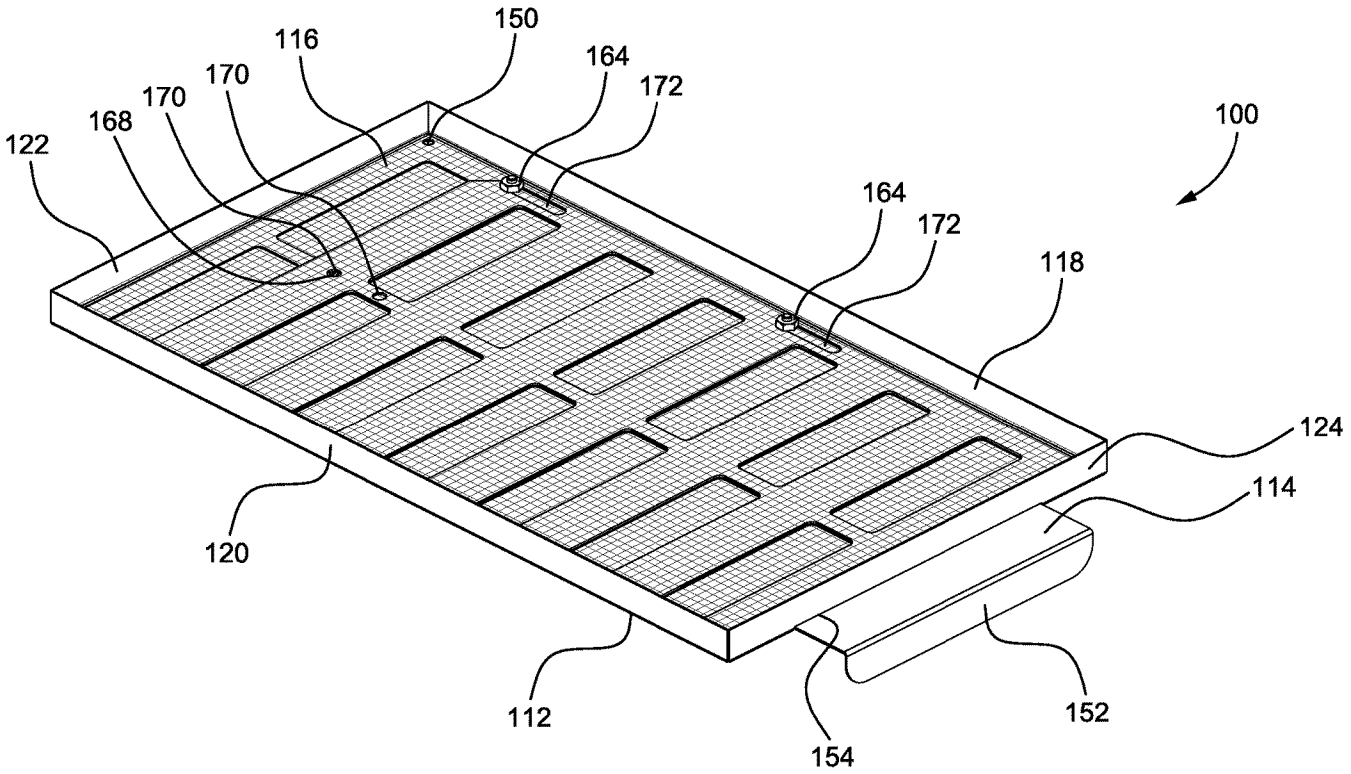

FIG. 6 is a perspective view showing the vent in the assembled state according to another embodiment of the present invention.

Figure 7:
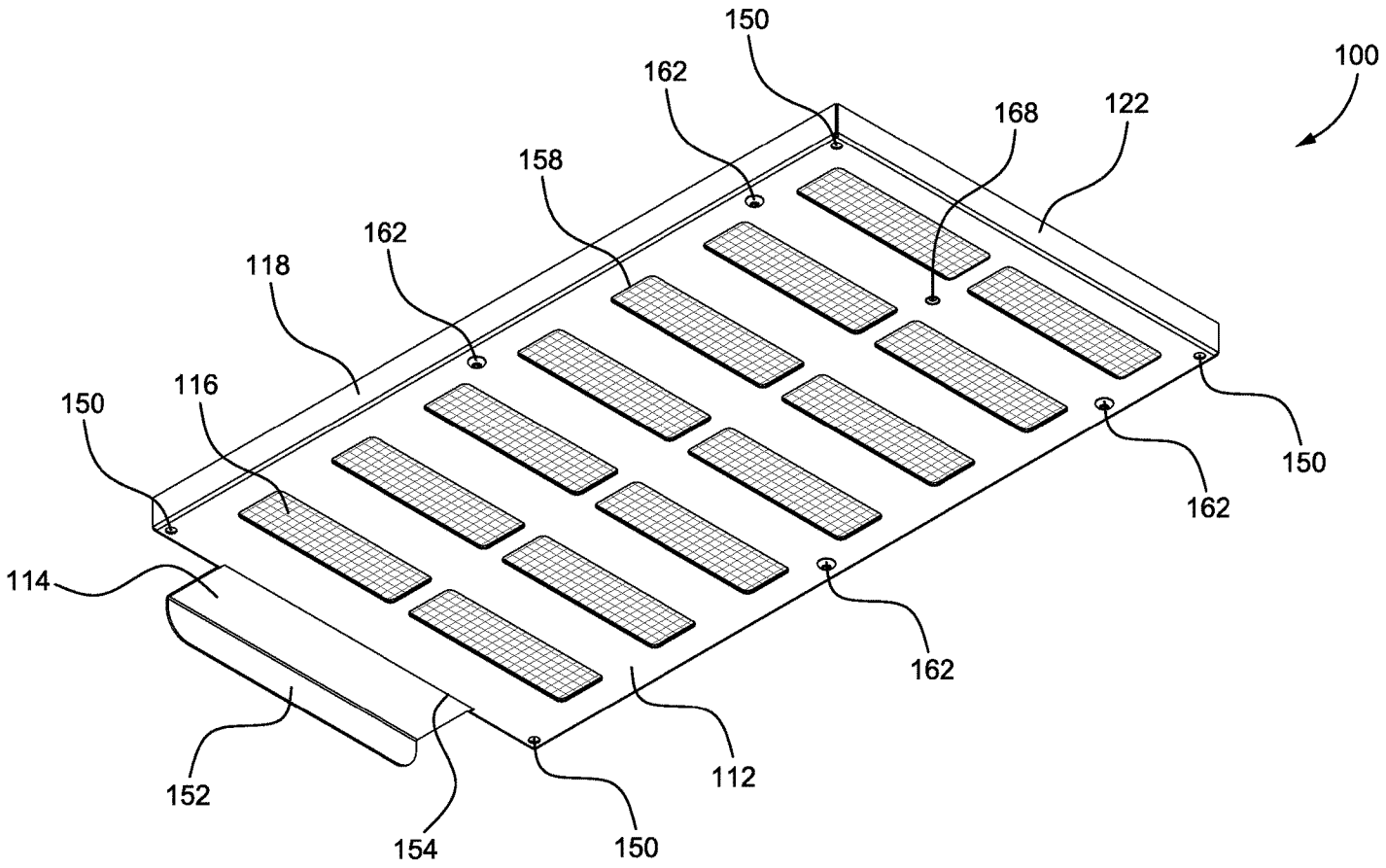

FIG. 7 is another perspective view showing the vent in the assembled state according to the other embodiment of the present invention.

Figure 8:
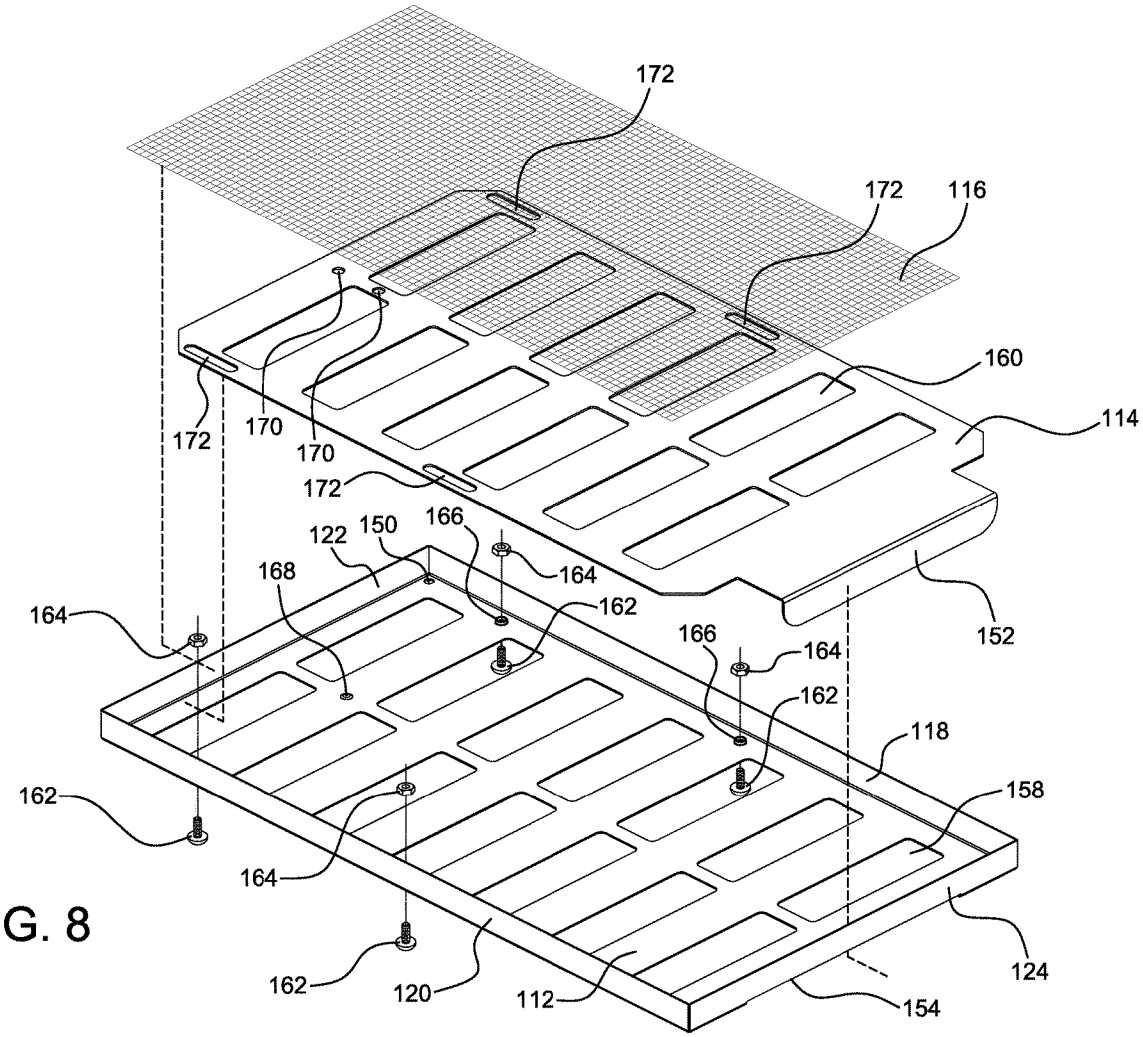

FIG. 8 is an exploded perspective view of the vent showing the metal screen, moveable slider and hardware separated from the rigid frame according to the other embodiment of the present invention.

Figure 9:
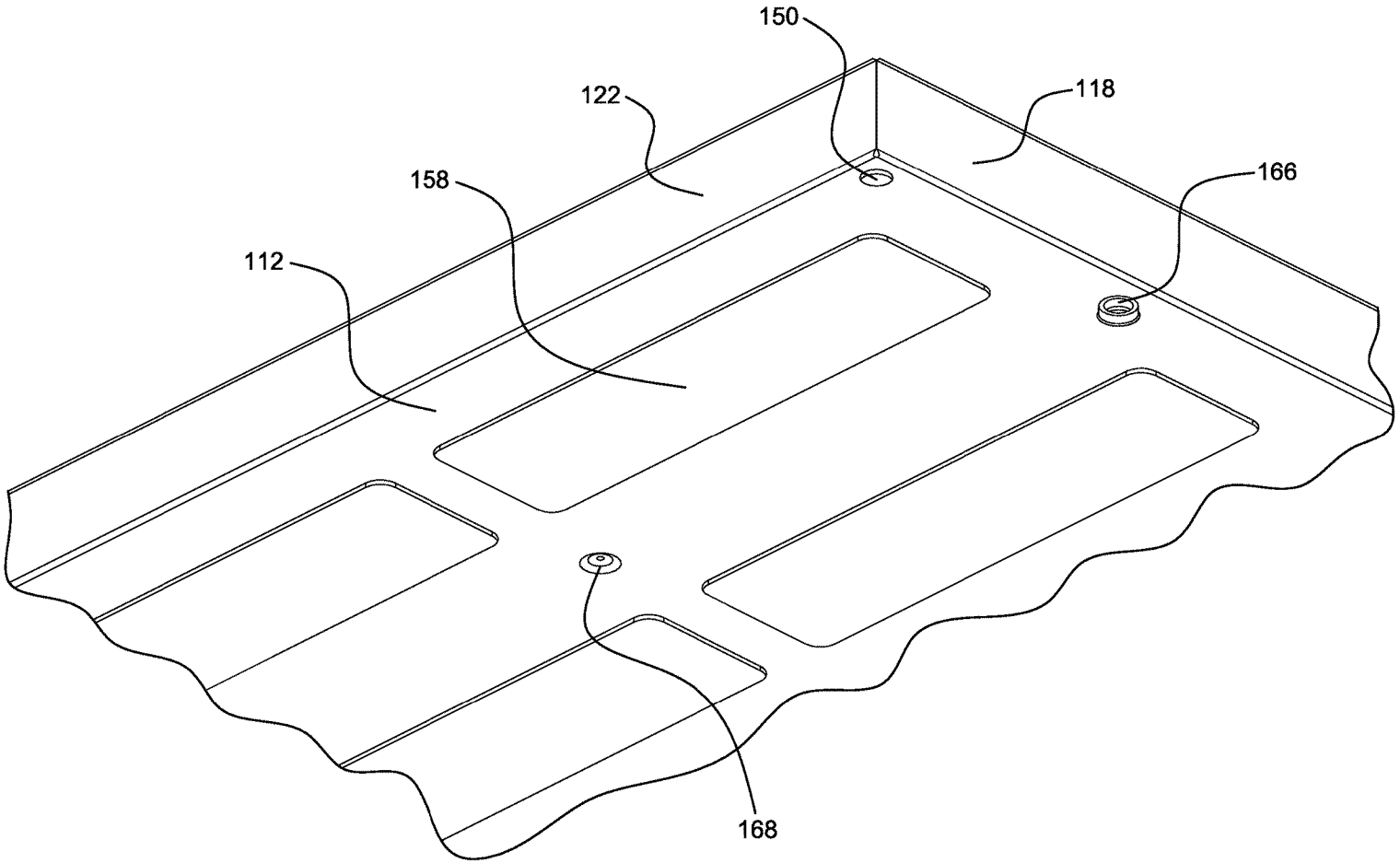

FIG. 9 is a partial perspective inside view of the rigid frame according to the other embodiment of the present invention.

Figure 10:
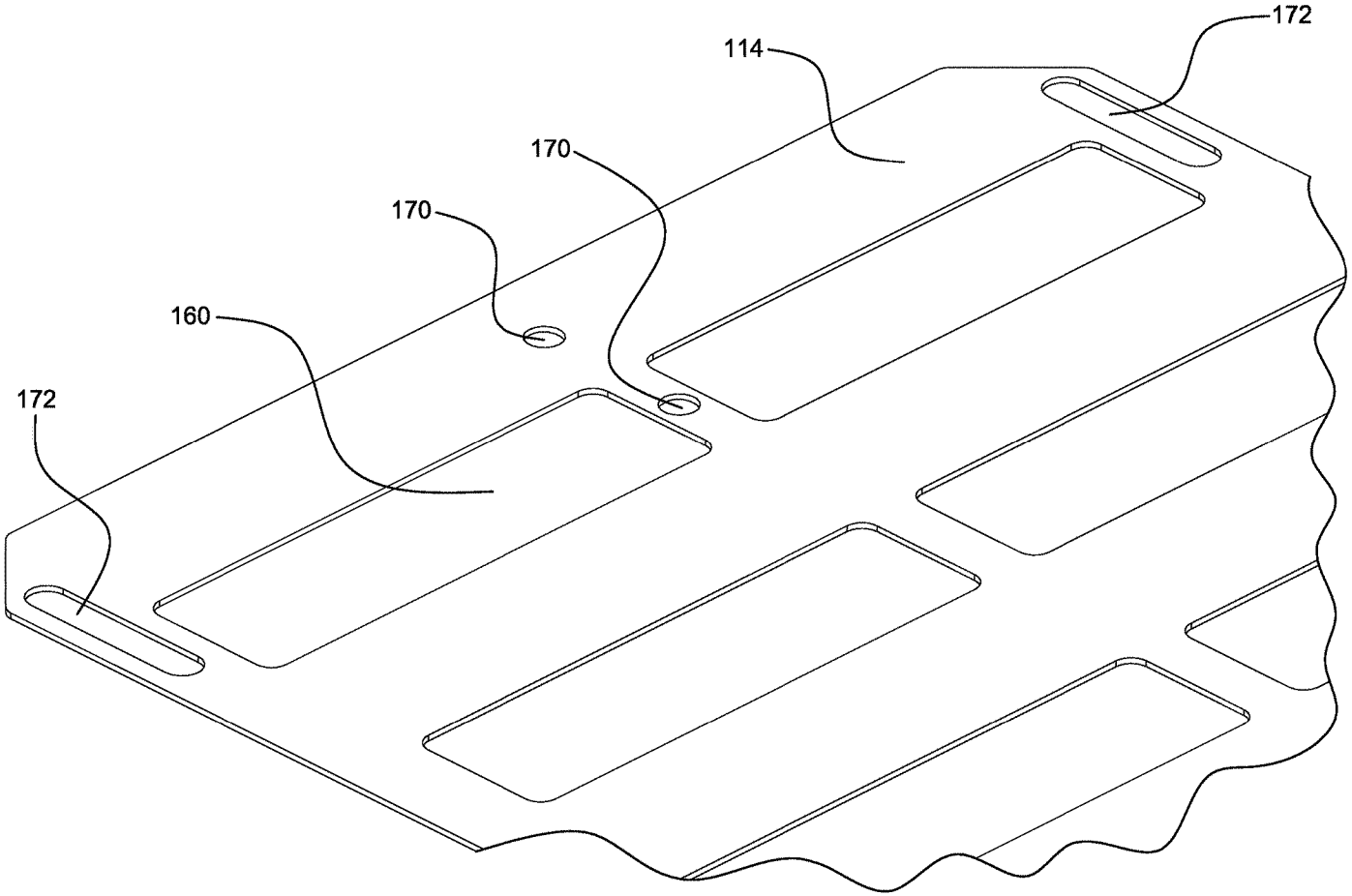

FIG. 10 is a partial perspective view showing the moveable slider according to the other embodiment of the present invention.

DETAILED DESCRIPTION

A First Embodiment Ventilation Vent Assembly

FIGS. 1-5 show various views of an embodiment of the vent assembly 10. FIGS. 1, 2 & 4 show the vent with its moveable slider 14 being located in an open position; whereas, FIG. 5 shows the slider in the closed position. Closable ventilation vent assembly 10 includes rigid frame 12, moveable slider 14, metal screen 16, and various assembly hardware.

In this embodiment as shown best in FIG. 3, rigid frame 12 is rectangular in shape, and includes four rigid frame opposing flanges 18, 20, 22, and 24 (or sidewalls) that extend orthogonally from a primary side to define an interior space (as best shown in FIG. 1). The rigid frame 12 includes a plurality of airflow openings 58, a plurality of openings for guide screws 44, a plurality of openings for retention screws 34, a plurality of openings for installation screws 50, and an opening 54 to receive actuation tab 52 of moveable slider 14.

The moveable slider 14, also best seen in FIG. 3, is rectangular in shape, and includes a plurality of openings for airflow 60, and includes actuation tab 52 on one end thereof. A metal screen 16 is also provided and is rectangular in shape and sized to fit within the rigid frame 12. The assembly hardware includes various nuts, screws, washers, and spacers for the purpose of retaining and guiding moveable slider 14 with respect to rigid frame 12.

Referring to FIGS. 4 & 5, the closable ventilation vent assembly 10 is configured to be attached to a soffit panel 56 for use in the ventilation of commercial and residential structures. The rigid frame 12 includes a plurality of openings 58 for airflow, and the moveable slider 14 includes a plurality of openings 60 for airflow. In this embodiment, the airflow openings in both the rigid frame 12 and the moveable slider 14 are similar in shape and spacing, and they may be aligned by pushing or pulling on the actuation tab of moveable slider 52, causing moveable slider 14 to move with respect to rigid frame 12. The opened position is defined by the airflow openings in both the rigid frame 12 and the moveable slider 14 being aligned such that the maximum amount of air is allowed to flow through the closable ventilation vent assembly 10 as is shown in FIG. 4. The closed position is defined by the airflow openings in both the rigid frame 12 and the moveable slider 14 being misaligned such that the minimum amount of air is allowed to flow through the closable ventilation vent assembly 10 as shown in FIG. 5.

FIG. 1 illustrates that a fiberglass or metal screen 16 is located immediately adjacent to moveable slider 14 and within the rigid frame opposing flanges numbered 18, 20, 22, and 24. Retention nuts 46 for the screen 16 are located immediately adjacent to, and in contact with, screen 16. The moveable slider 14 is located between rigid frame 12 and metal screen 16, and within the rigid frame opposing flanges numbered 18, 20, 22, and 24. The actuation tab 52 of moveable slider 14 is located within, and protrudes through an opening 54 in the rigid frame. The opening is typically slightly wider than the width of the tab but narrower than the width of the remainder of the slider.

FIG. 2 shows an exterior perspective view of the present invention in an assembled state, and with the moveable slider 14 being located in the open position. When the moveable slider 14 is located in the open position, screen 16 is visible through the openings 58. The end of the actuation tab 52 is generally orthogonal to the substantially planar slider 14 and extends outwardly. Explained another way, the moveable slider 14 is installed within rigid frame 12 such that actuation tab 52 is pointed in the opposite direction than that of the rigid frame opposing flanges 18, 20, 22, and 24

FIG. 3 shows an exploded interior perspective view of the present invention illustrating one configuration of the various elements that comprise closable ventilation vent assembly 10. In this configuration, the moveable slider 14 is guided and retained with respect to rigid frame 12. The moveable slider 14 is positioned directly adjacent to, and in contact with, rigid frame 12, with actuation tab 52 being located within, and protruding through the opening 54 in the end of the rigid frame 12. The moveable slider 14 is slidably connected to rigid frame 12.

With reference to FIG. 3, a method of assembling the vent assembly is described. First, the moveable slider 14 is installed into rigid frame 12. Next, retention screws 26 are inserted through retention screw openings 34 in rigid frame 12. Retention screw spacers 30 are then slid over and installed onto retention screws 26 such that they are immediately adjacent to and generally in contact with the rigid frame 12, as well as, immediately adjacent to moveable slider 14. The spacers are slightly thicker than the thickness of the plate comprising the movable slider. The washers 28 are installed onto retention screws 26 over the spacers 30, with a portion of each washer 28 covering the edge of moveable slider 14, effectively trapping both the spacers 30 and moveable slider 14 between the washers 28 and the rigid frame 12. Nuts 32 are threaded onto retention screws 26, and threaded all the way down to meet washers 28. In a similar and analogous fashion the guide screws 36 and associated washers 38, spacers 40 and nuts 42 are installed in rigid frame 12. When complete the retention and guide screws along with the associated hardware help retain and guide the movable slider between its open and closed positions.

After the slider 14 has been installed a screen is typically installed over it. It is to be appreciated as discussed supra, variations of the vent assembly, especially for use over flush mounted soffit vents, the screen is omitted as unnecessary. The screen 16 is installed by aligning existing openings in screen 16 with protruding retention screws 26 and protruding guide screws 36. The screen 16 is then pushed onto retention screws 26 and guide screws 36, such that the screen 16 is immediately adjacent to and in contact with retention nuts 32 and guide nuts 42. A second nut 46 is threaded onto each retention screw 26 and each guide screw 36, such that nuts 46 are located immediately adjacent to, and in contact with screen 16 effectively securing the screen in place between a pair of nuts on each screw.

FIGS. 4 & 5 are perspective views showing the vent assembly installed onto a soffit panel 56, with the moveable slider 14 being in the open and closed positions respectively. The vent assembly 10 is installed on a soffit and over a soffit opening by inserting installation screws 48 through installation screw openings 50 and into the soffit panel 56, or other applicable material onto which the vent assembly is being installed. When the closable ventilation vent assembly 10 is installed, and moveable slider 14 is located in the open position, screen 16 is readily visible through the openings 58 located in rigid frame 12. When the vent assembly 10 is installed, the orthogonal end of the actuation tab 52 of moveable slider 14 is protruding in a direction that is directed away from the soffit panel 56, or other surface onto which the closable ventilation vent assembly 10 is installed. When the moveable slider 14 is in the open position, only the actuation tab 52 is visible to a person viewing the present invention from the exterior of the structure, and the remainder of moveable slider 14 is obscured by the rigid frame 12. The actuation tab in particular, and typically the movable slider as a whole, is often brightly colored and/or highly reflective making it easily visible even at significant distances therefrom.

When the closable ventilation vent assembly 10 is installed and moveable slider 14 is located in the closed position as shown in FIG. 5, the screen 16 is not visible through the openings 58 located in rigid frame 12. Further, when the moveable slider 14 is located in the closed position, large portions of moveable slider 14 are visible through the openings 58. Specifically, when the moveable slider 14 is in the closed position, only the orthogonal end of the actuation tab 52 is visible to a person viewing the present invention from the exterior of the structure but large portions of moveable slider 14 are visible through the openings 58 to a person viewing the present invention from the exterior of the structure. When, as is typical, the moveable slider 14 is brightly colored and/or highly reflective, the portions of the moveable slider in the openings 58 are easily visible even at significant distances therefrom.

One can then appreciate that since the rigid frame 12 is colored differently than moveable slider 14, the resulting visual contrast between these two elements would be most apparent when moveable slider 14 is in the closed position. This contrast effectively enables one to see from a distance whether the closable ventilation vent assembly 10 is in the opened or closed position. In at least one variation, the rigid frame 12 is painted with a dark colored flat or semigloss paint and the moveable slider 14 is painted with a light colored glossy paint. In other variations, the moveable slider 14 and actuation tab 52 are metallic and reflective, such as with galvanized steel, in contrast to a non-reflective painted rigid frame 12, the resulting portions of the moveable slider 14 visible through the airflow openings 58 in rigid frame 12 are readily apparent when the moveable slider 14 is in the closed position. This reflectivity effectively enables one to see from a distance (preferably 25 feet or more and more preferably from 50 feet or more) whether the closable ventilation vent assembly 10 is opened or closed. One can further appreciate that when the moveable slider 14 is in the open position, the contrast between the color of the rigid frame 12 and the color of the deployed actuation tab 52 is readily noticeable especially where the actuation tab 52 is reflective in contrast to a non-reflective rigid frame 12. The variations in color, contrast, and reflectivity of the various elements of the vent assembly permit one to quickly identify that the vent assembly is installed on a structure and whether the vents are open or closed. This can be very useful to firefighters and other emergency personnel trying to protect structures in a forest fire situation by allowing them to make quick assessments from a distance as to the state of a structure within range of a fire without the need to perform a time consuming up close inspection.

A Second Embodiment Ventilation Vent Assembly

FIGS. 6-10 show a second embodiment of the vent assembly 100. The construction and configuration of the second embodiment is generally similar the first embodiment except for the differences noted herein. For reference, all element numbers sharing the same last two digits with the element numbers referenced in FIGS. 1-5 refer to similar elements. For sake of brevity, the similar elements of the second embodiment are not specifically described or discussed in this section except for differences they may have relative to the similar element of the first embodiment or if necessary to completely describe newly introduced elements in context.

Like the first embodiment, the second embodiment includes a rigid frame 112, a movable slider 114 having an actuation tab 152, an optional screen 116, and various assembly and mounting hardware. The rigid frame 112 differs from the first embodiment frame in several aspects: (i) it is wider than the first embodiment; (ii) it includes an inwardly projecting dimple 168 proximate the end of the frame opposite the actuation tab opening 154 and adjacent flange 122; and (iii) it includes integrally formed annular standoffs 166 that replace the spacers 30 & 40 and washers 28 &38 of the previous embodiment.

The movable slider 114 differs from the first embodiment slider in width as well. The additional width can be seen along the lengthwise edges of the slider, which include a wider strip between each lengthwise edge and the side of the edges of the respective adjacent airflow openings 160. Within each strip a pair of lengthwise extending slots 172 of a predetermined length are provided. The movable slider 114 further includes a pair of spaced apart holes 170 that correspond in location to the dimple 168 of the rigid frame 112.

Referring primarily to FIG. 8, the assembly and operation of the second embodiment is described. The actuation tab 152 is passed through the provided actuation tab opening 154 in the rigid frame 112 and the moveable slider 114 is laid against the interior surface of the frame such that each annular standoff 166 is received in a respective slot 172. The standoffs act as guides for the movement of the slider 114 between the open and closed positions. Retaining fasteners 162 are passed through the standoffs and secured in place with associated threaded nuts 164. The nuts are wider than the slots 172 and therefore hold the moveable slider 114 in place within the vent assembly. In variations wherein a screen 116 is provided, additional nuts (not shown) can be provided to secure the screen in place once it is placed over the posts of the retaining fasteners 162. Alternatively, as shown, the screen 116 can be placed over the posts of the retaining fasteners 162 against the slider 114 and secured in place with the associated threaded nuts 164. Operationally, the standoffs 166 further act as stops limiting the movement of the slider 114 wherein the standoff is positioned against one end of the slot 172 in the closed position and the other end of the slot 172 in the open position. Further, the dimple 168 corresponds with one of the pair of holes 170 in each of the open and closed positions wherein the holes 170 are sized to receive the dimple 168 therein to hold or lock the slider in place in the desired position.

Similarly to the first embodiment, the frame 112 and slider 114 of the second embodiment are differently colored and/or include highly reflective surfaces/coatings to create a contrast when viewed from a distance.

Alternative Embodiments and Other Variations

Numerous variations to the vents are contemplated as well as variations in how the vents are utilized. The vent embodiments described above pertain primarily to use on soffits. Similar vents can find use in numerous other applications where closable vents are desired. For instance, variations of the above embodiments could be used to provide ventilation for crawl spaces and basements or can be fitted to gable ends or rooftops instead of soffits.

The shape, configuration and sizes of the vents can vary substantially and significantly. The number and configuration of vent openings can vary. The shape of the vent itself can vary. The slider can be positioned over the rigid frame on certain variations instead of inside of it. The screen, when the vent is fitted with one, can also be positioned in any number of places, such as on the outside of the frame or sandwiched between the interior surface of the frame and the surface of the slider Two means of retaining the slider to the frame are described in the provided embodiments; however, different means are contemplated. For instance, through stamping and other metal working processes, channels can be formed in the frame that act to guide the slider eliminating the need for threaded fasteners for that purpose. In other variations, C-channels or L-channels can be mounted to the frame creating slots or tracks in which the edges of the slider can ride. As can be appreciated, there are many possibilities.

In the second embodiment, a dimple 168 is provided on the rigid frame 112 that corresponds with holes 170 in the slider to effectively secure the slider in its open or closed positions. In variations, different mechanisms that serve essentially the same purpose can be employed. For instance, a spring clip with a detent end can be employed wherein the detent end is biased into openings in the slider to lock the slider in open and closed positions. Numerous location are possible to fit a spring clip and associated receiving openings.

The actuator tabs on the sliders of the described embodiments both include orthogonal ends that make it easier for a user to push in and pull out the slider, such as with an elongated rod, to move it between the open and closed positions. Variations are contemplated that have differently configured sliders that may not incorporate an orthogonal end. For instance, in one variation, the slider comprises two opposed actuator tabs, each of which extend outwardly of an opposite end of the frame. To move the slider into the open position, the user pushes the tab on one end inwardly, which causes the tab on the other end to extend outwardly. To subsequently move the slider to the closed position, the user pushes the other tab inwardly. In other variations, the location of the tab can vary as well. The tab can comprise an appendage that extends from the elongated side of the frame instead of an end wherein the user pushes the tab right or left to open or close the vent.

Variations are completed that incorporate a solenoid or other type of electric actuator that when properly wired to a switch and power supply permit a user to open and close the slider remotely. The actuator can replace the actuator tabs or be provided in addition to them, such that a user can also move the slider manually if power fails. In another variation, mounting holes, associated tabs and/or cutouts can be provided on the frame and slider respectively to receive a solenoid as an option or retrofit.

The colors of the various components can also vary substantially and a single component, such as the slider can comprise multiple colors. For instance in some embodiments, the portion forming the vent opening covers can be painted a loud color, such as fluorescent orange, to make it more noticeable to a person from a distance when the vent is in the closed position, but the tab itself may remain or retain a more subdued color since in the normally open position it is regularly visible.

I claim:

1. A vent assembly for under the soffit of a home, the assembly comprising:

a rectangular frame having an exterior and an interior, the frame including (i) a primary side having exterior and interior surfaces, (ii) a plurality of sidewalls extending generally orthogonally from the edges of the primary side and defining an interior space, (ii) a plurality of frame airflow openings distributed on the primary side, (iii) an elongated slot located at the intersection of the primary side and one side of the plurality of sidewalls, and (iv) the frame includes a plurality of openings having annular standoffs integrally formed therearound and extending into the interior space from the interior surface, the frame comprising a first color substantially all of the exterior surface; and a substantially planar generally rectangular-shaped slider received and slidably secured against the primary side of the frame within the interior space, the slider including (a) a plurality of slider airflow opening distributed thereon in a pattern corresponding to a pattern of the plurality of frame airflow openings on the primary side, (b) an actuator tab extending from an edge thereof, the actuator tab further including a generally orthogonally extending end, the actuator tab having a width sized to be received through the elongated slot, and (c) the slider includes a plurality of slider slots, each slot being received over a annular standoff the slider comprising a second color, the second color being reflective and contrasting with the first color;

a plurality of threaded fasteners and plurality of threaded nuts, the plurality of fasteners being received through the plurality of openings and annular standoffs with the plurality of threaded nuts being threaded onto the plurality of fasteners over the slider slots; and a screen, the screen being received in the interior space on top of the slider over posts of the plurality of fasteners;

wherein the slider is configured to move between first and second positions, the plurality of frame airflow openings and the plurality of slider airflow openings being substantially aligned and coincident and the actuator tab being substantially exposed in the first position providing for the free flow of air between the exterior and the interior through the airflow openings, and the plurality of frame airflow openings and the plurality of slider airflow openings being substantially misaligned and the actuator tab being substantially contained within the interior space in the second position with the slider covering the frame airflow openings and preventing the flow of air between the exterior and interior.

2. The vent assembly of claim 1, wherein: (1) primary side further includes a dimple extending away from the interior surface; (2) the slider includes first and second receiving holes longitudinally aligned with the dimple; (3) the dimple is received in the first hole when the slider is in the first position; and (4) the dimple is received in the second hole when the slider is in the second position.

* * * * *